US007847689B1

(12) United States Patent
Woitalla et al.

(10) Patent No.: US 7,847,689 B1
(45) Date of Patent: Dec. 7, 2010

(54) INTRUDER ALARM DEVICE

(76) Inventors: Larry Woitalla, 25053 285th Ave., Pierz, MN (US) 56364; Michelle M. Seppelt, 25053 285th Ave., Pierz, MN (US) 56364

( * ) Notice: Subject to any disclaimer, the term of this patent is extended or adjusted under 35 U.S.C. 154(b) by 340 days.

(21) Appl. No.: 11/968,957

(22) Filed: Jan. 3, 2008

(51) Int. Cl.
*G08B 13/08* (2006.01)
*H01H 3/02* (2006.01)

(52) U.S. Cl. ..... 340/545.2; 200/61.93

(58) Field of Classification Search ..... 340/573.6, 340/545, 549, 693, 545.2; 200/61.93
See application file for complete search history.

(56) References Cited

U.S. PATENT DOCUMENTS

| | | | | | |
|---|---|---|---|---|---|
| 1,374,684 | A | | 4/1921 | Rieck | |
| 3,312,968 | A | | 4/1967 | Kiefer, Jr. | |
| 3,406,386 | A | * | 10/1968 | Hawkins | 340/542 |
| 3,893,095 | A | * | 7/1975 | DeJong | 169/23 |
| 4,194,193 | A | | 3/1980 | McDonough | |
| 4,376,276 | A | * | 3/1983 | Barta | 340/549 |
| 4,604,609 | A | * | 8/1986 | Wakefield, Jr. | 340/548 |
| 4,721,946 | A | | 1/1988 | Zunkel | |
| 5,243,325 | A | | 9/1993 | Marin et al. | |
| D343,804 | S | | 2/1994 | Sims | |
| 5,469,139 | A | * | 11/1995 | Ko | 340/545.4 |
| 5,686,890 | A | * | 11/1997 | Ko | 340/545.1 |
| 5,754,107 | A | | 5/1998 | Ferrantelli | |
| 5,907,352 | A | * | 5/1999 | Gilley | 348/151 |

* cited by examiner

*Primary Examiner*—Benjamin C Lee
*Assistant Examiner*—Sigmund Tang
(74) *Attorney, Agent, or Firm*—Crossley Patent Law; Mark A. Crossley

(57) ABSTRACT

An intruder alarm device that is designed to be mounted on an inside door frame of the front door of a home and sound an alarm, if activated, when the door is opened. The device includes an outer casing that is mounted adjacent to a door and includes a trigger that can be placed immediately in front of the door. If the door is opened while the trigger is in front of the door, the trigger touches a contact within the device and activates an alarm, which then audibly alerts individuals within the home that the door has been opened. The alarm continues to sound until the trigger is returned to vertical position.

5 Claims, 4 Drawing Sheets

INTRUDER ALARM DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved intruder alarm device that is designed to be mounted on an inside door frame of the front door of a home and sound an alarm when activated by opening the door while a trigger on the device is in horizontal position, extending in front of the door.

SUMMARY OF THE INVENTION

The present invention concerns that of a new and improved intruder alarm device that is designed to be mounted on an inside door frame of the front door of a home and sound an alarm when activated by opening the door when the trigger is in horizontal position. The device includes an outer casing that is mounted adjacent to a door and includes a trigger that can be placed immediately in front of the door. If the door is opened while the trigger is in front of the door, the trigger touches a contact within the device and activates an alarm, which then audibly alerts individuals within the home that the door has been opened. The alarm continues to sound until the trigger is returned to a vertical position.

There has thus been outlined, rather broadly, the more important features of an intruder alarm device that the detailed description thereof that follows may be better understood and in order that the present contribution to the art may be better appreciated. There are, of course, additional features of the intruder alarm device that will be described hereinafter and which will form the subject matter of the claims appended hereto.

In this respect, before explaining at least one embodiment of the intruder alarm device in detail, it is to be understood that the intruder alarm device is not limited in its application to the details of construction and to the arrangements of the components set forth in the following description or illustrated in the drawings. The intruder alarm device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the intruder alarm device. It is important, therefore, that the claims be regarded as including such equivalent constructions insofar as they do not depart from the spirit and scope of the present invention.

It is therefore an object of the present invention to provide an intruder alarm device which has all of the advantages of the prior art and none of the disadvantages.

It is another object of the present invention to provide an intruder alarm device which may be easily and efficiently manufactured and marketed.

It is another object of the present invention to provide an intruder alarm device which is of durable and reliable construction.

It is yet another object of the present invention to provide an intruder alarm device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
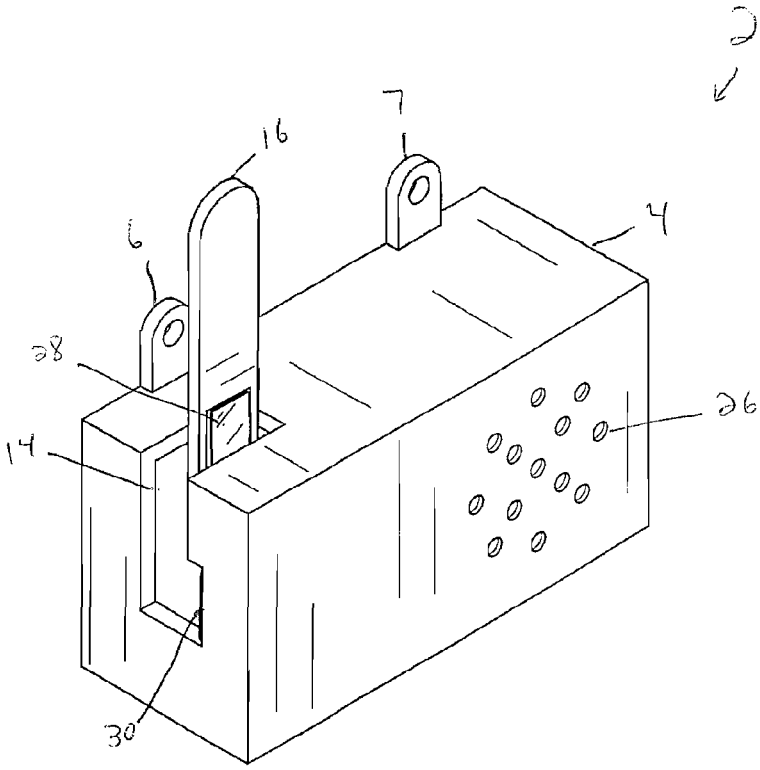
FIG. 1 shows a front perspective view of the intruder alarm device as it would appear in a deactivated mode.
Figure 2:
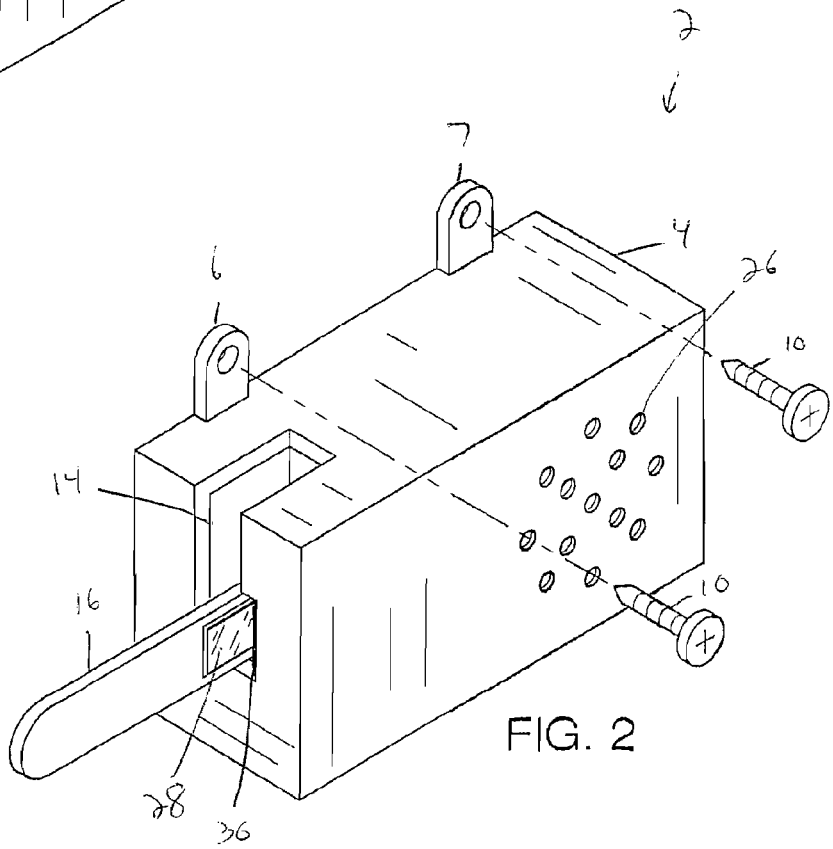
FIG. 2 shows a front perspective view of the intruder alarm device as it would appear in an activated mode.
Figure 3:
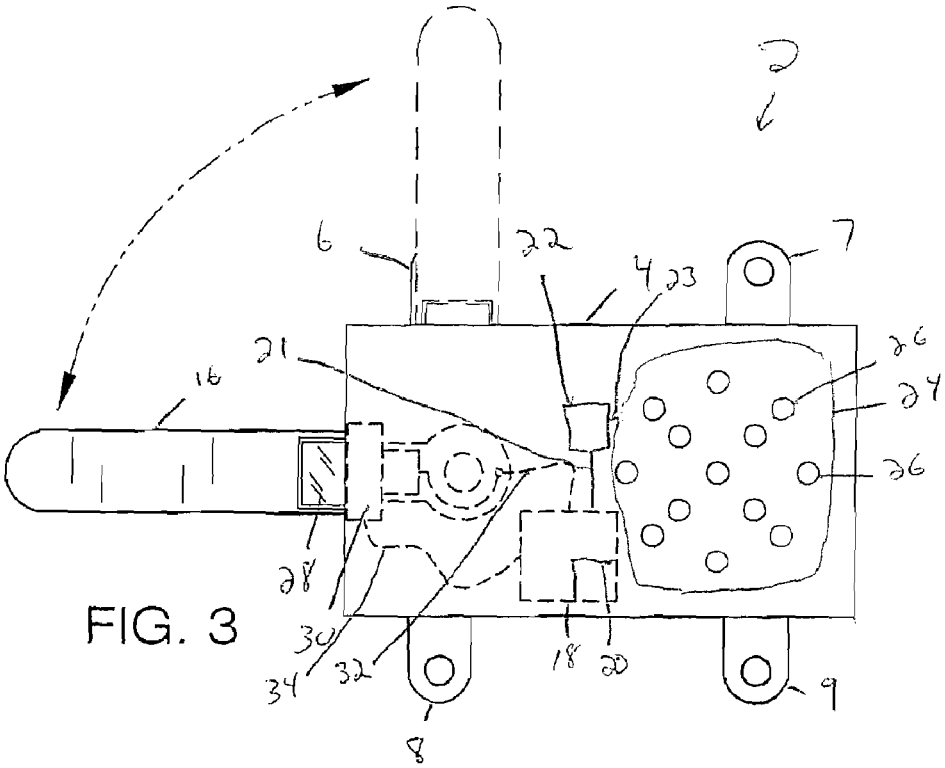
FIG. 3 shows a front cutaway view of the intruder alarm device, highlighting the two positions of the trigger.
Figure 4:
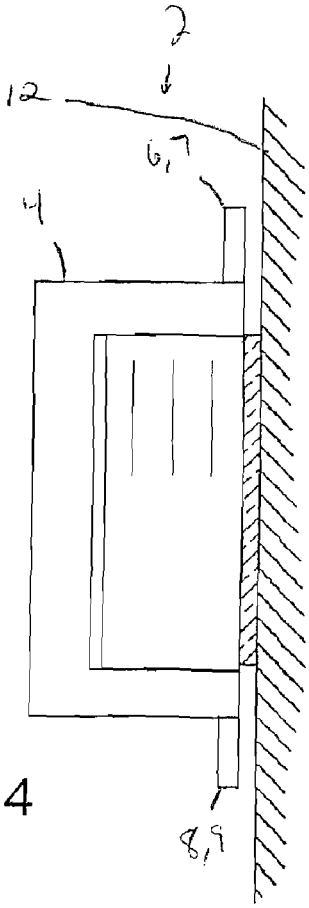
FIG. 4 shows a side view of the intruder alarm device.
Figure 5:
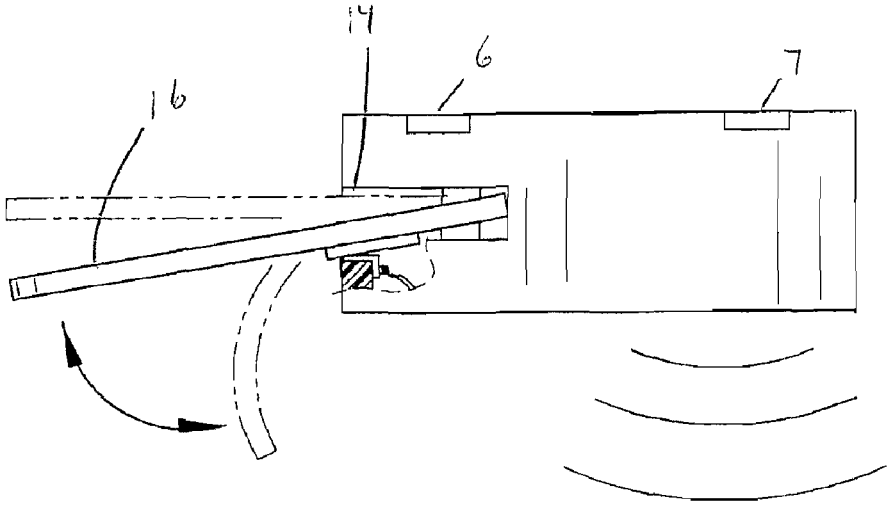
FIG. 5 shows a top view of the intruder alarm device, highlighting the two positions of the trigger.
Figure 6:
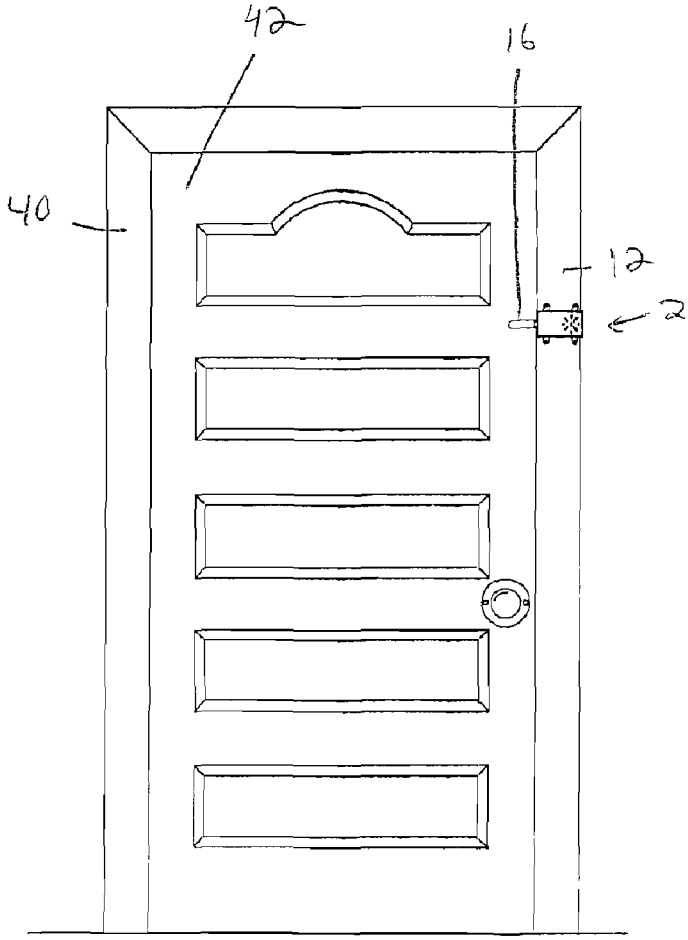
FIG. 6 shows a front view of the intruder alarm device as it would appear in an activated mode, mounted adjacent to a door within a home.
Figure 7:
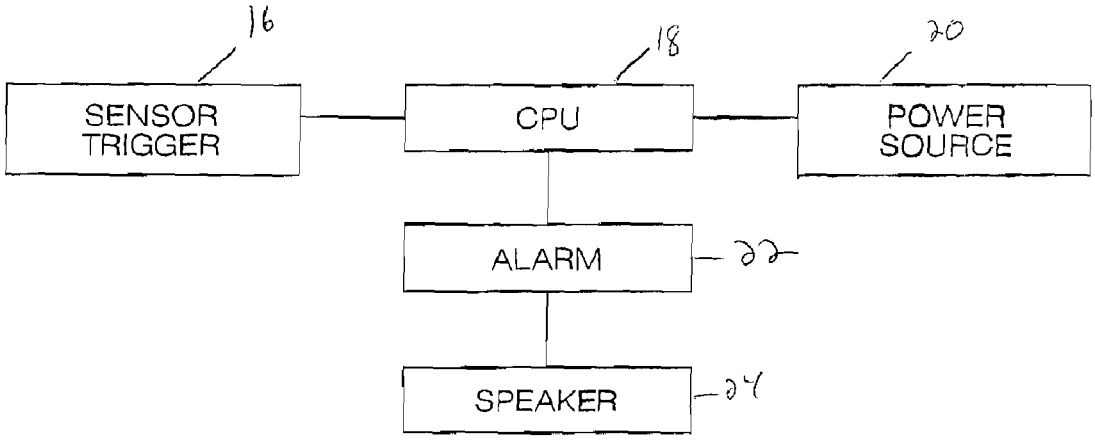
FIG. 7 shows an electronic schematic of the various electronic components within the device and how they are connected to one another.

With reference now to the drawings, and in particular to FIGS. 1 through 7 thereof, a new intruder alarm device 2 embodying the principles and concepts of the present invention and generally designated by the reference numeral 2 will be described.

As best illustrated in FIGS. 1 through 7, the intruder alarm device 2 comprises an outer casing 4 that has four external mounts 6, 7, 8 and 9. The outer casing 4 preferably has a rectangular or cubical shape and is capable of being mounted by fastening devices 10 that are combined with the mounts 6 and 8 to secure the device 2 to a vertical surface 12.

The outer casing 4 also has a slot 14 in it, and furthermore, has a trigger 16 that is axially attached within the outer casing 4. The trigger 16 extends out through the slot 14 and has an extendible range of 90 degrees. The trigger 16 can be anywhere between a vertical position to a horizontal position and extends outward from the outer casing 4 approximately three to four inches. For purposes of this device 2, the trigger 16 is in a disarmed state when the trigger 16 is in a vertical position and in an activated state when the door is opened while the trigger 16 is in a horizontal position.

The device 2 includes an internal central processing unit (CPU) 18 that is preferably powered by a battery 20. Furthermore, the device 2 includes an internal alarm 22 that, when activated, makes a sound that can be heard through speaker 24. Outer casing 4 has a plurality of holes 26 immediately adjacent to the speaker 24, allowing the sounds emitted by the speaker 24 to be heard externally from the device 2. CPU 18 is connected to the alarm 22 through a wire 21, while alarm 22 is connected to speaker 24 via wire 23. Trigger 16 has a contact 28 located on it, while a second contact 30 is located on the outer casing 4. Contact 28 is connected via wire 32 to the CPU 18, while contact 30 is connected to the CPU via wire 34. Contact 28 is immediately adjacent to contact 30 when the trigger 16 is a horizontal, or activated state.

In use, the outer casing 4 of the device 2 is mounted on a door frame 40 immediately adjacent to a door 42. In fact, the portion of the outer casing 4 where the slot 14 is located should be placed flush against a side of the door. If an individual wants to "disarmed" the device 2, he or she need to merely put the trigger 16 in a vertical position, thereby preventing the trigger 16 from being tripped when the door 42 is opened. However, when an individual wants to activate the device 2, he or she can put the trigger 16 in a horizontal, or "armed," position. Then, once the door 42 is opened, the contact 28 on the trigger will be pushed into the contact 30 on the outer casing 4. Once this occurs, the electrical connection in between the two contacts 28 and 30 will be complete, and the CPU 18, sensing this fact, will notify the alarm 22 to audibly make sounds through the speaker 24. The alarm continues to sound until it is deactivated by returning the trigger 16 to vertical position.

With respect to the above description then, it is to be realized that the optimum dimensional relationships for the parts of the present vehicle air freshener device to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An intruder alarm device comprising:

an outer casing, means for mounting the outer casing to a vertical surface, detection means for detecting if an individual enters a room in which the intruder alarm device is located and activated, notification means for notifying a homeowner that an individual has walked into a room in which the intruder alarm device is located, wherein the vertical surface further comprises a door frame, said door frame being located immediately adjacent to a door, wherein the outer casing has a rectangular or cubical shape, wherein the means for mounting the outer casing to a vertical surface further comprises:

a quartet of external mounts, wherein each external mount is attached to the outer casing, a plurality of fastening devices, wherein a fastening device is used to attach each external mount to the vertical surface, wherein the detection means for detecting if an individual enters a room in which the intruder alarm device is located further comprises:

a slot located on the outer casing, a trigger axially attached within the outer casing, the trigger extending outward through the slot, said trigger having an extendible range from a vertical position to a horizontal position, wherein the trigger is in a disarmed state when the trigger is in a vertical position, further wherein the trigger is in an armed state when the trigger is in a horizontal position, a central processing unit located within the outer casing, power means for providing power to the central processing unit, an internal alarm located within the outer casing, the internal alarm being connected to the central processing unit, and means for activating the internal alarm responsive to when the trigger in the horizontal position is being pushed by a door against a side of the slot on the outer casing.

2. An intruder alarm device according to claim 1 wherein the power means for providing power to the central processing unit further comprises at least one battery located within the outer casing.

3. An intruder alarm device according to claim 2 wherein the notification means for notifying a homeowner that an individual has walked into a room in which the intruder alarm device is located further comprises (a) a speaker located within the outer casing, the speaker being connected to the internal alarm, (b) a plurality of holes located on the outer casing immediately adjacent to the speaker, (c) wherein the speaker makes sounds that are heard through the plurality of holes if the internal alarm is activated.

4. An intruder alarm device according to claim 3 wherein the means for activating the internal alarm further comprises:

(d) a first contact located on the trigger, the first contact being connected to the central processing unit, (e) a second contact located on the outer casing, the second contact being connected to the central process unit, (f) wherein the first contact is immediately adjacent to the second contact when the trigger is in a horizontal position, (g) wherein the door, when opened and pushed against the trigger, causes the first contact to be forced into contact with the second contact, thereby completing a circuit in between the battery and the internal alarm, thereby activating the internal alarm.

5. An intruder alarm device comprising:

(a) an outer casing, the outer casing having a rectangular or cubical shape, (b) means for mounting the outer casing to a vertical surface, said vertical surface further comprising a door frame, said door frame being located immediately adjacent to a door, said means further comprising (i) a quartet of external mounts, wherein each external mount is attached to the outer casing, (ii) a plurality of fastening devices, (iii) wherein a fastening device is used to attach each external mount to the vertical surface, (c) detection means for detecting if an individual enters a room in which the intruder alarm device is located and activated, said detection means further comprising (i) a slot located on the outer casing, (ii) a trigger axially attached within the outer casing, the trigger extending outward through the slot, said trigger having an extendible range from a vertical position to a horizontal position, wherein the trigger is in a disarmed state when the trigger is in a vertical position, further wherein the trigger is in an armed state when the trigger is in a horizontal position, (iii) a central processing unit located within the outer casing, (iv) power means for providing power to the central processing unit, said power means further comprising at least one battery located within the outer casing, (v) an internal alarm located within the outer casing, the internal alarm being connected to the central processing unit, and (vi) means for activating the internal alarm, said means further comprising (1) a first contact located on the trigger, the first contact being connected to the central processing unit, (2) a second contact located on a side of the slot on the outer casing, the second contact being connected to the central process unit, (3) wherein the first contact is immediately adjacent to the second contact when the trigger is in a horizontal position, (4) wherein a door, when opened and pushed against the trigger, causes the first contact to be forced into contact with the second contact, thereby completing a circuit in between the battery and the internal alarm, thereby activating the internal alarm and, (d) notification means for notifying a homeowner that an individual has walked into a room in which the intruder alarm device is located, said notification means further comprising (i) a speaker located within the outer casing, the speaker being connected to the internal alarm, (ii) a plurality of holes located on the outer casing immediately adjacent to the speaker, (iii) wherein the speaker makes sounds that are heard through the plurality of holes if the internal alarm is activated.

* * * * *